US007382066B2

(12) United States Patent
Foster et al.

(10) Patent No.: US 7,382,066 B2
(45) Date of Patent: Jun. 3, 2008

(54) ROTARY SWITCH WITH RATCHETING FEATURE

(75) Inventors: William L. Foster, Don Mills (CA); Sam K. Chung, Markham (CA)

(73) Assignee: Motorola, Inc., Schaumburg, IL (US)

( * ) Notice: Subject to any disclaimer, the term of this patent is extended or adjusted under 35 U.S.C. 154(b) by 536 days.

(21) Appl. No.: 10/784,068

(22) Filed: Feb. 19, 2004

(65) Prior Publication Data

US 2005/0184595 A1 Aug. 25, 2005

(51) Int. Cl.
*H01H 3/00* (2006.01)

(52) U.S. Cl. ..... 307/139

(58) Field of Classification Search ..... 307/139
See application file for complete search history.

(56) References Cited

U.S. PATENT DOCUMENTS 3,734,869 A * 5/1973 Menard et al. ..... 200/11 R
4,190,749 A 2/1980 Erickson et al.
6,307,304 B1 10/2001 Yorio et al.
6,326,949 B1 12/2001 Merminod et al.
6,404,354 B1 * 6/2002 Decker et al. ..... 341/35
2003/0038018 A1 2/2003 Lin

FOREIGN PATENT DOCUMENTS

EP 0 889 881 A2 3/1999
EP 1 150 243 A2 10/2001

* cited by examiner

*Primary Examiner*—Robert L. Deberadinis
(74) *Attorney, Agent, or Firm*—Barbara R. Doutre

(57) ABSTRACT

A rotary switch (102) for an electronic device (100) includes a bump stop (104) that triggers a ratcheting feature when hit. The range of the rotary switch (102) is expanded via the ratcheting feature. The ratcheting feature inhibits scrolling through a device parameter in one rotation direction and enables scrolling through the device parameter in the opposite rotation direction. Depending on which direction the bump stop (104) is hit, the parameter is either incremented or decremented. The range of the rotary switch can also be expanded by modifying the step size of the rotary switch based on the range of a selected parameter (504). The coarse step is then narrowed with each change in rotation direction (510, 518) based on current, previous and useable switch positions (512, 514).

25 Claims, 4 Drawing Sheets

300

300

400

ROTARY SWITCH WITH RATCHETING FEATURE

TECHNICAL FIELD

This invention relates in general to electronic devices, and more particularly to rotary switches used in electronic devices.

BACKGROUND

A rotary switch is often used as means for selecting an electronic device parameter. For example, a rotary switch may operate as a channel selector on a public safety radio to give quick, simple access to a number of channels. The switch typically provides a continuous rotary "increment/decrement" function but is limited by the number of physical positions on the switch. A separate "zone" switch is sometimes used in conjunction with the rotary switch to allow access to separate banks of channels, but each bank of channels is still limited by the number of physical positions on the switch. The ability to provide increased channel selection, or other parameter, is highly desirable.

In the case of the public safety radio, there are many users, such as fire fighters wearing bulky gloves, who prefer that the rotary switch have a mechanical stop feature. The mechanical stop feature allows the switch to be turned fully counterclockwise to select, for example an emergency channel, and fully clockwise to select a default normal operating channel. This operation is easy to do without looking at the radio while it is mounted on a belt or harness. However, the mechanical stop limits the use of the switch to that one selected channel. The ability to select different types of parameters, such as channel, zone, and coding scheme, as well as an increased selection within each parameter is also highly desirable.

Accordingly, there is a need for an improved rotary switch for an electronic device, such as a radio, that provides increased parameter selection with good tactile feedback for the user.

BRIEF DESCRIPTION OF THE DRAWINGS

The features of the present invention, which are believed to be novel, are set forth with particularity in the appended claims. The invention, together with further objects and advantages thereof, may best be understood by reference to the following description, taken in conjunction with the accompanying drawings, in the several figures of which like reference numerals identify like elements, and in which:

DETAILED DESCRIPTION OF THE PREFERRED EMBODIMENT

Figure 1:
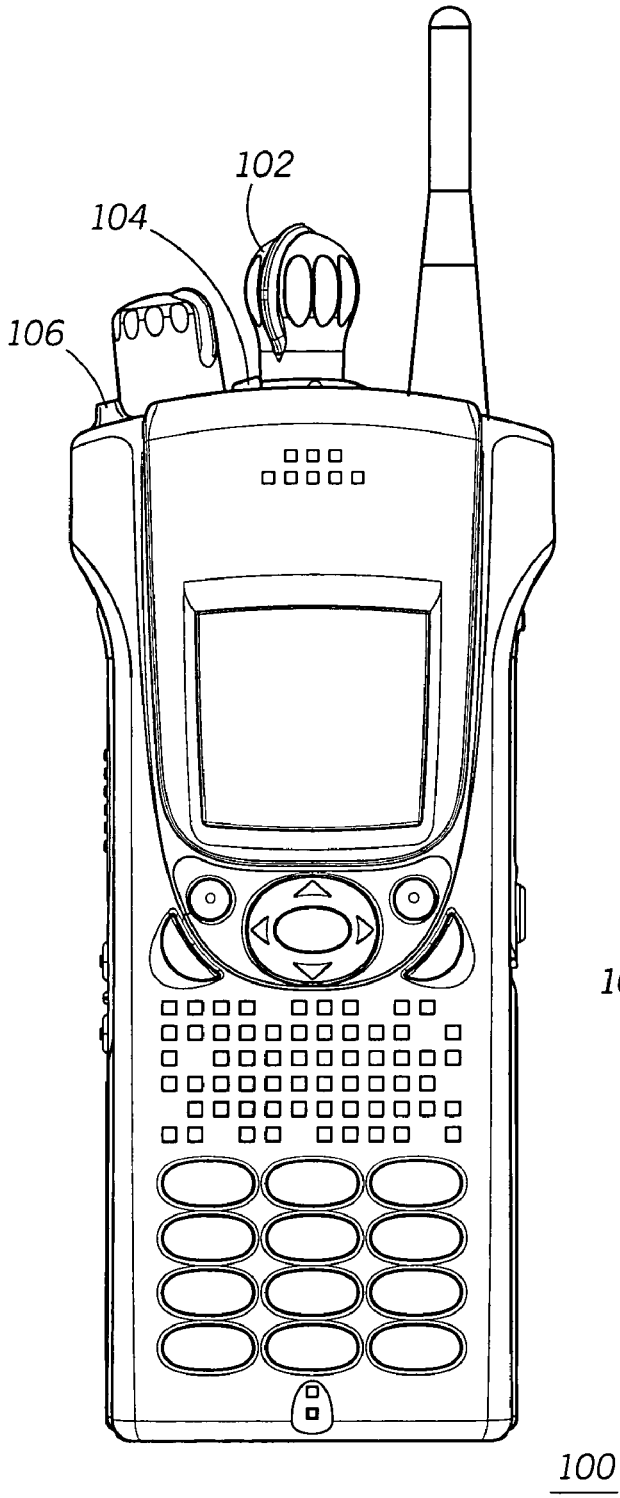
FIG. 1 is an electronic device formed in accordance with the present invention.

While the specification concludes with claims defining the features of the invention that are regarded as novel, it is believed that the invention will be better understood from a consideration of the following description in conjunction with the drawing figures, in which like reference numerals are carried forward.

Figure 2:
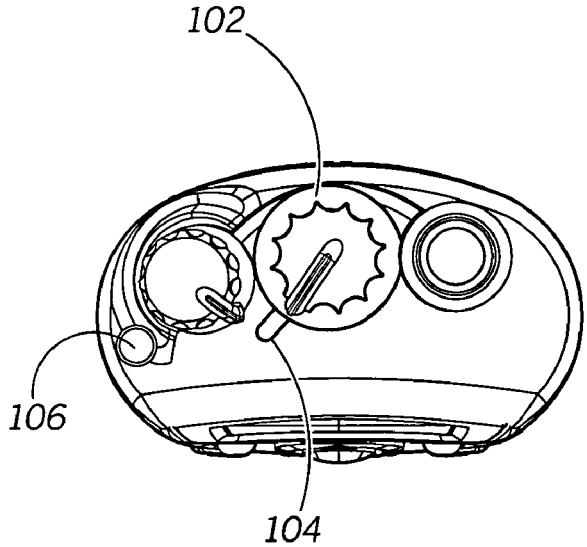
FIG. 2 is a top view of the electronic device of FIG. 1 formed in accordance with the present invention.

In accordance with the present invention, there is provided herein a rotary switch having a ratcheting feature for facilitating scrolling through a plurality of device parameters. FIGS. 1 and 2 are front and top views of an electronic device 100, shown here as a radio communication device. In accordance with the present invention communication device 100 includes a rotary switch 102 for scrolling through a scrollable parameter, a bump stop 104 for inhibiting rotation of the rotary switch and triggering a ratcheting function for the rotary switch, and preferably an input 106 for enabling and disabling a plurality of scrollable parameters. Scrollable operating parameters for the communication device 100 can be selected from, but are not limited to, channel, zone, and coding schemes.

Rotary switch 102 is capable of rotating in a first direction and a second (reverse) direction. In accordance with the present invention, the rotary switch 102 hitting the bump stop 104 in the first direction enables ratcheting in a second direction and incrementing a device parameter in the first direction. The rotary switch 102 hitting the bump stop in the second direction enables ratcheting in the first direction and decrementing the device parameter in the second direction. By hitting the bump stop 104 in either direction the user is able to ratchet rapidly up or down the scrollable parameter list. Reversing direction of rotation without hitting the bump stop 104 simply leaves the rotary switch 102 in plain increment/decrement mode. Input 106 allows for the selection of various parameters through which the rotary switch 102 can scroll.

Figure 3:
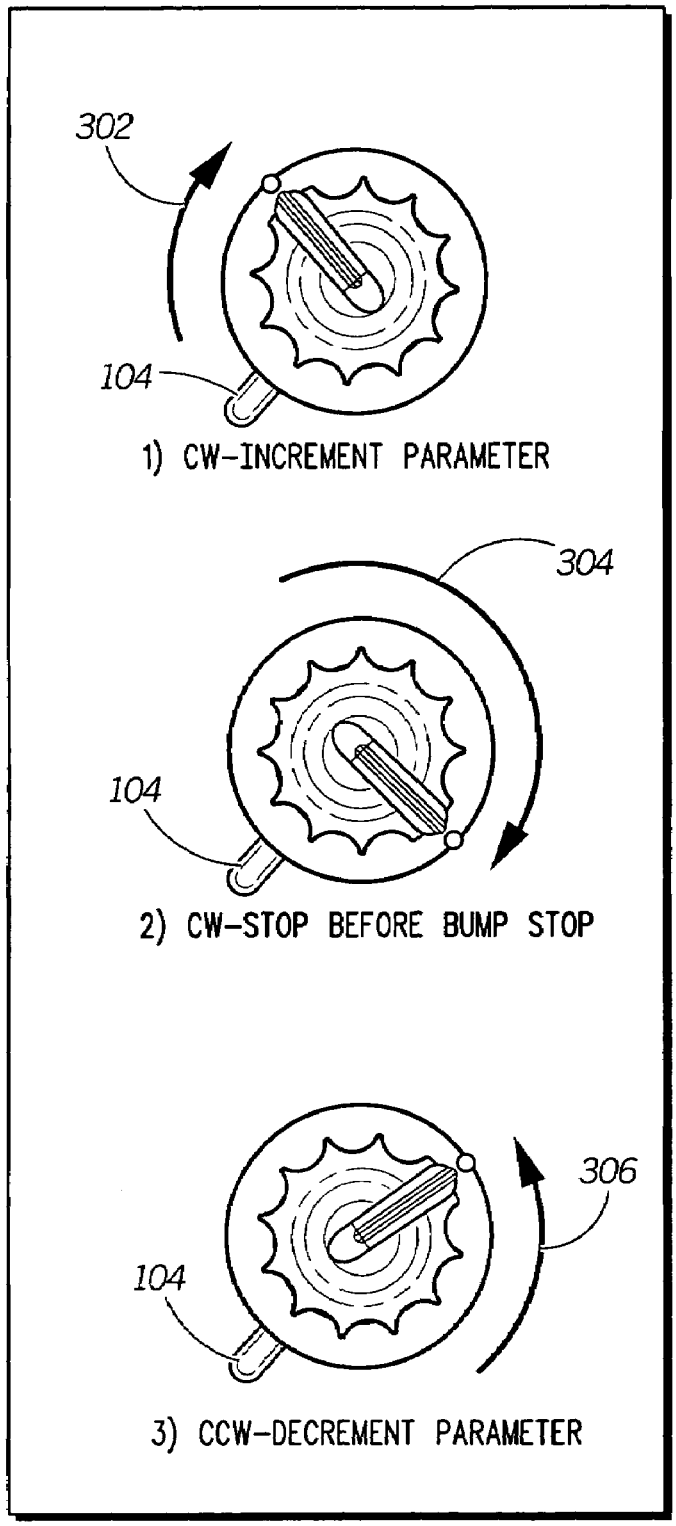
FIG. 3 is the rotary switch of FIG. 1 operating in accordance with the present invention.
Figure 4:
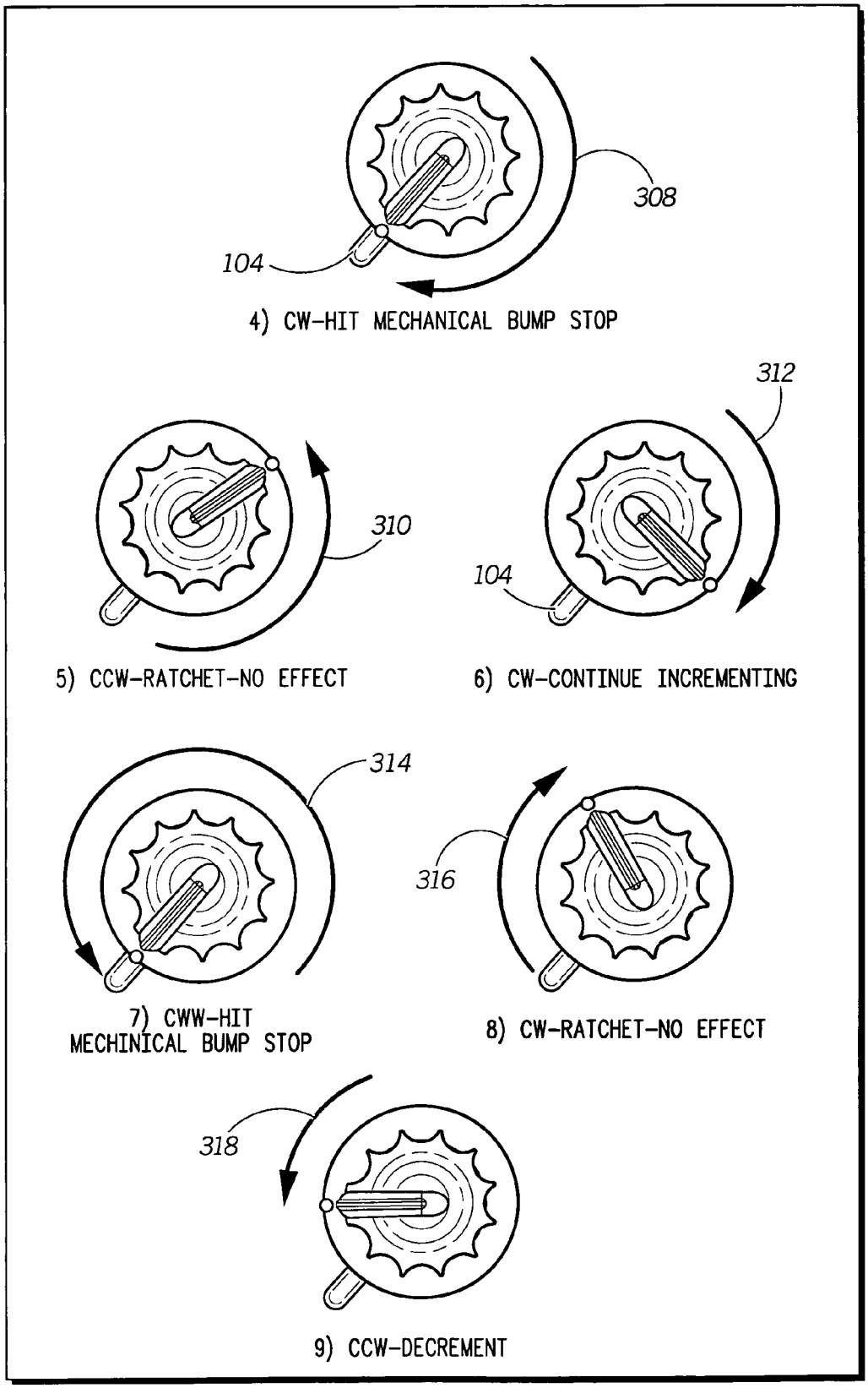
FIG. 4 is the rotary switch of FIG. 3 operating in accordance with the present invention.

Referring now to FIGS. 3 and 4, a top view of the rotary switch 102 is shown operating in accordance with a preferred embodiment of the invention through a series of rotations 300, 400 labeled (1)-(9). For the purposes of this example, rotation in the first direction will be considered to be in the clockwise direction and rotation in the second direction will be considered to be in the counterclockwise direction. The rotary switch 102 initially increments and decrements through a first scrollable parameter, a default parameter, regardless of hitting the bump stop. Input 106 is then enabled thereby disabling the first scrollable parameter and enabling a second scrollable parameter. Rotation of the rotary switch 102 in the clockwise direction 302 now increments the second parameter. Continued clockwise rotation 304, stopping prior to hitting the bump stop 104, continues to increment the second parameter, and rotation in the counterclockwise direction 306 decrements the second parameter (i.e. regular increment/decrement functionality).

The rotary switch 102 continues to increment and decrement the second scrollable parameter with clockwise and counterclockwise rotations until the bump stop 104 is hit with full clockwise rotation 308, view (4). In accordance with the present invention, in response to the bump stop 104 being hit in the clockwise direction 308, the ratcheting feature is enabled in the counterclockwise direction 310 and incrementing of the second scrollable parameter is enabled in the clockwise direction 312. Thus, once the ratcheting feature is triggered in the clockwise direction, turning the rotary switch 102 in the counterclockwise direction has no effect on the second parameter. The action of rotate clockwise (hit bump stop), reverse rotate counterclockwise (do not hit bump stop), and rotate clockwise (hit bump stop) continues the increment/ratchet/increment feature of the present invention. If the user pauses midway through a clockwise rotation (without hitting bump stop) as seen back in view (2) designator 304 and then reverses rotation as seen in view (3) designator 306, the second parameter will decrement. Thus, the user can easily scroll to the desired parameter.

In response to the bump stop 104 being hit in the counterclockwise direction 314 view (7), the ratcheting function is enabled in the clockwise direction 316 and decrementing of the second scrollable parameter occurs in the counterclockwise direction 318. Thus, once the ratcheting function is triggered in the counterclockwise direction, turning the rotary switch in the clockwise direction has no effect on the second parameter. The action of rotate counterclockwise (hit bump stop), reverse rotate clockwise (do not hit bump stop), and rotate counterclockwise (hit bump stop) continues the decrement/ratchet/decrement feature of the present invention. If the user pauses midway through a counterclockwise rotation (without hitting bump stop) and then reverses rotation, the second parameter will increment. Thus, the user can easily scroll to the desired parameter.

As an example, input 106 can disable a channel change parameter that scrolls up and down through sixteen channels (first parameter) and enables a PL code parameter having say fifty PL codes (second parameter). If the bump stop 104 is located in between positions one and sixteen then switch 102 will initially scroll up and down through sixteen of the fifty PL codes. To scroll to higher level PL codes, the user rotates the switch all the way in the clockwise direction until the bump stop 104 is hit. By hitting the bump stop 104 in the clockwise direction, the ratcheting feature is triggered. Rotation in the opposite (counterclockwise) direction will no longer impact the PL code, but subsequent clockwise rotation will increment the PL code. The user continues to repeat the clockwise rotation (hitting bump stop), reverse rotation counterclockwise (without hitting bump stop), and rotate clockwise (hitting the bump stop) until the desired PL code is reached or nearly reached. To further facilitate reaching the desired parameter, the user may pause midway through a clockwise rotation (without hitting bump stop) and then reverse rotate the switch so as to decrement the parameter.

Now to decrement the PL code, the user rotates switch 102 counterclockwise until the bump stop 104 is hit which triggers the ratcheting feature to be enabled in the opposite (clockwise) direction. The user continues to repeat the counterclockwise rotate (hit bump stop), reverse rotate in clockwise direction (without hitting bump stop), and counterclockwise rotate (hitting bump stop) until PL code is decremented to the desired level. To assist the user in reaching the desired parameter, the user may pause midway through a counterclockwise rotation (without hitting bump stop) and then reverse rotate the rotary switch so as to increment the parameter.

The rotary switch of the present invention can be configured with a number of bump stops and different bump stop locations if desired. For example, as an alternative to having one bump stop located between the first and last positions of the rotary switch 102 as described above, two bump stops can be used that are located at the first and last switch positions. In the case of a sixteen channel switch, once the bump stop is hit (at position one or sixteen) the user is left with fourteen usable switch positions through which to scroll and ratchet. Thus, a communication device that has a default function such as "emergency" located at channel 16 can maintain channels one through fifteen and emergency until input 106 is enabled. Once input 106 is enabled, a second scrollable parameter is turned on and channels 1 and 16 function as bump stops.

The input 106 can be used to enable other parameters as well. Thus, the same rotary switch can be used to accommodate many different electronic device parameters each parameter having different scrollable levels. The physical limitations of the switch are no longer a factor in determining the number of available scrollable parameters. The user can now easily scroll through a number of different parameter types and different levels/positions within each type through a single rotary switch.

While shown and described in the preferred embodiment as using an input 106 to select one of a plurality of device type parameters, the ratcheting feature of the present invention is also useful for applications utilizing a single type of device parameter. If design requirements are such that one parameter type is sufficient, then input 106 is no longer needed. The ratcheting feature still provides an increased number of positions from which to select within that one parameter. For example, a radio communication device having rotary switch 102 operating as a channel selector having sixteen channels can increase the number of available channels by simply hitting the bump stop to enable the ratcheting feature as described above. The user can then scroll up and down the channels as desired.

Another alternative embodiment allows incrementing of the scrollable parameter to occur in both clockwise and counter clockwise directions of the rotary switch. In this case, the user rotates the switch 102 clockwise to increment the parameter and hits the bump stop 104 so that counterclockwise rotation continues to increment the parameter. Subsequent clockwise rotation (hitting the bump stop) and counterclockwise rotation continues to increment the parameter. If the bump stop is not hit each time in the clockwise direction, then counterclockwise rotation decrements the parameter. In other words, the action of hitting of the bump stop triggers the ability to increment or decrement in the counterclockwise direction. Thus, the use of the bump stop in accordance with the present invention, triggers the ability to increment and decrement the plurality of scrollable parameters of a rotary switch.

Accordingly, there has been provided a rotary switch for an electronic device that includes a bump stop for inhibiting rotation of the rotary switch, the bump stop triggering a ratcheting feature that inhibits scrolling through an electronic device parameter in one rotation direction and enables scrolling through the electronic device parameter in the opposite rotation direction. Depending on which direction the bump stop gets hit, scrolling may increment the electronic device parameter or decrement the electronic device parameter.

Electronic devices such as public safety radios, cell phones, set top boxes, and other equipment using rotary switch interfaces can all benefit from the ratcheting feature of the present invention. A single rotary switch having a fixed number of positions can now provide additional scrolling capability to one or more types of parameters through the ratcheting feature of the present invention. The use of the bump stop to trigger the ratcheting feature provides good tactile feedback for the user.

Figure 5:
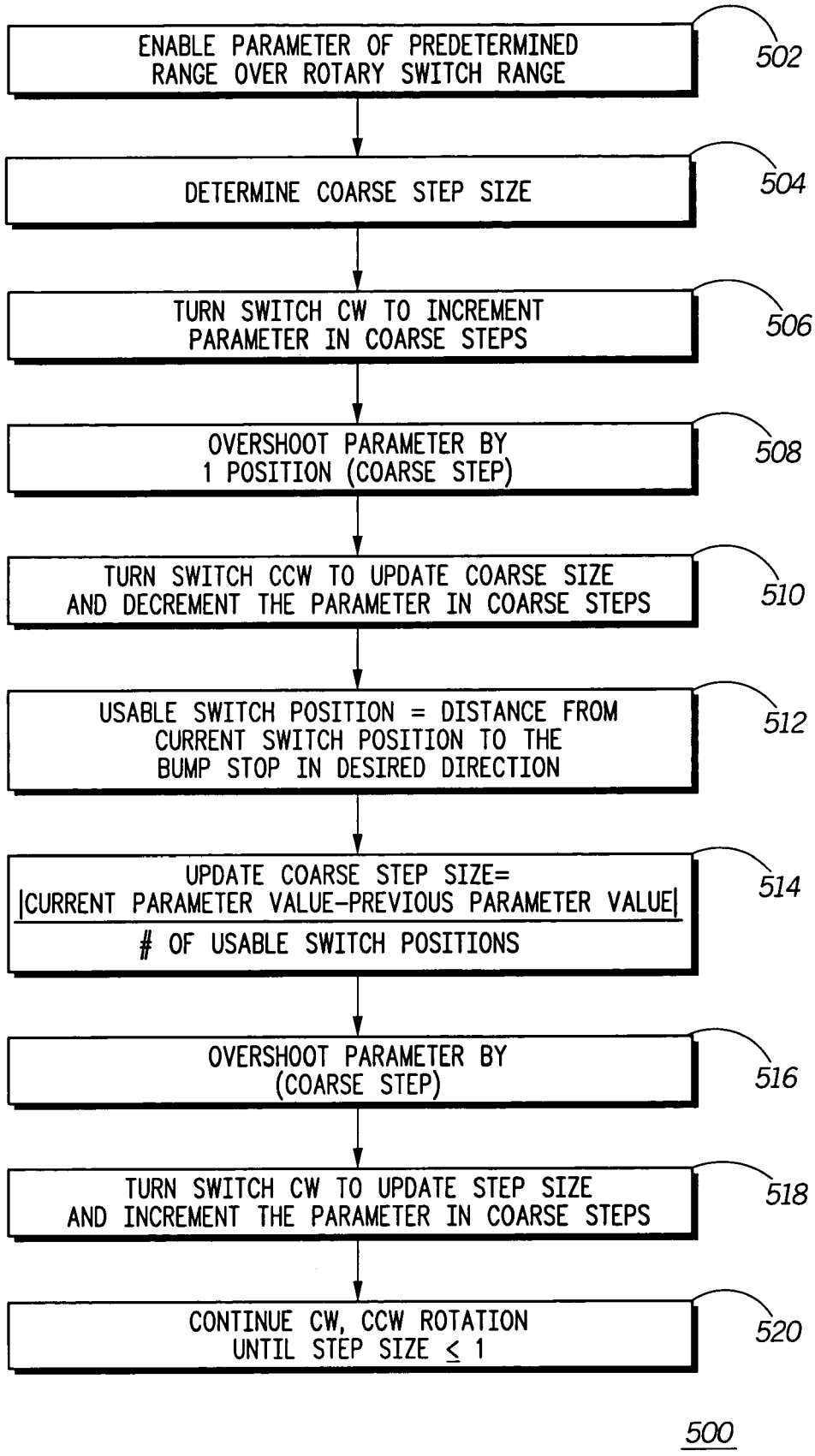
FIG. 5 is a method of expanding the range of a rotary switch for an electronic device in accordance with an alternative embodiment of the invention.

In accordance with another embodiment of the invention, there is further provided herein a method for expanding the range of a rotary switch for an electronic device. For the purposes of this application, the rotary switch is characterized by a predetermined number of positions. Here again, the press of a button or menu selection on the electronic device, such as button 106 on radio communication device 100 of FIG. 1, changes the device parameter from a default parameter to some other user selected parameter. Referring to the flowchart 500 of FIG. 5, the entire range of the enabled parameter is spread across the range of movement of the rotary switch at 502 which determines a coarse step size at 504. For example, if the entire range of the enabled parameter is 0-1000, then this range is spread across the range of movement of the rotary switch (say 1-16) giving a coarse step size of 1001/15=66.7. Turning the rotary switch clockwise increments the parameter with the coarse step size towards a desired parameter value at 506.

In accordance with this embodiment, the user overshoots the desired parameter value by one position 508 (i.e. one coarse step). Turning the rotary switch counterclockwise 510 now updates the coarse step size and decrements the device parameter with the updated coarse step size. The updated coarse step size is determined via steps 512 and 514. Upon reversing the rotation of the rotary switch direction at 510, the number of usable switch positions is determined at 512 and this number of usable switch positions is used to determine the updated coarse step size, 514. For the purposes of this application, the number of usable switch positions is determined by the distance from current switch position to the bump stop 104 in the desired direction of rotation. In accordance with this embodiment, the updated coarse step size is determined at 514 using: absolute value of (current parameter value−previous parameter value)/number of usable switch positions.

The user continues to turn the rotary switch counterclockwise until the user overshoots the desired parameter value by one position, 516. Turning the rotary switch clockwise now updates the coarse step size and increments the parameter. As before, updating of the coarse step size is based on the current parameter value, the previous parameter value, and the number of usable positions. The user continues clockwise and counterclockwise rotations, zeroing in on the desired parameter value until the step size reaches one or less.

Continuing with the example, an initial coarse step size of 66.7 was determined for a rotary switch having sixteen positions and a parameter range 0-1000. For a desired value of 669, starting at 0 (switch position 1 of 16), the number of rotary positions and parameter values turning clockwise (step 506) are as follows (rounding off):

position 1, parameter=67,
position 2, parameter=133,
position 3, parameter=200,
position 4, parameter=267,
position 5, parameter=333,
position 6, parameter=400,
position 7, parameter=467,
position 8, parameter=533,
position 9, parameter=600,
position 10, parameter=667,
position 11, parameter=733, (overshoot by one position)

Now turning the rotary switch counterclockwise (steps 510, 512, 514) the following occurs:

The number of usable switch positions is now 11 (distance from current switch position to bump stop in direction of rotation).

The updated coarse step size is thus |(current parameter value-previous parameter value)|/number of usable switch positions=|733−667|/11=6

Using the updated coarse step size of 6 in the counterclockwise direction provides the following:

position 12, parameter=727,
position 13, parameter=721,
position 14, parameter=715,
position 15, parameter=709,
position 16, parameter=703,
position 17, parameter=697,
position 18, parameter=691,
position 19, parameter=685,
position 20, parameter=679,
position 21, parameter=673,
position 22, parameter=667, (overshoot by one position)

Now turning the rotary switch clockwise (step 518) enables the following:

The number of usable switch positions is 16 (distance from current switch position to bump stop in direction of rotation).

$$\text{The updated coarse step size} = \frac{|(\text{current parameter value} - \text{previous parameter value})|}{\text{number of usable switch positions}}$$

The updated coarse step size is now |667−673|/16<1, so use updated coarse step size of 1.

position 23, parameter=668,
position 24, parameter=669

Thus, in 24 rotary position transitions (like one and a half full rotations of the 1-16 rotary switch), and two switch direction transitions, the desired parameter value of 669 out of 1001 possible values has been achieved.

The method of expanding the rotary switch range allows a switch with a limited number of physical positions to be used for other operating parameters having wider ranges than the default parameter. The switch action is quite natural for the user to learn in that the user just continues to rotate the switch back and forth zeroing in on the desired parameter value. The range of the rotary switch is capable of being reset to the initial coarse step size via a user input, such as hitting the bump stop twice in quick succession or other interface means.

The method described above can be varied in a number of ways depending on the design requirements of the electronic device. For some designs it may be desirable to change the direction of rotation to increment in the counterclockwise direction and decrement in the clockwise direction. Design conditions may warrant using an overshoot of N>1 positions rather than a single position. While using more than one position will require more switch transitions to narrow the range, this may provide improved user interface as the user realizes they have overshot the desired parameter and need to change rotation direction. Undershooting the desired parameter value by one or more positions can also be used instead of overshooting in order to alter the step size and adjust the parameter. For an undershooting implementation, the adjustment to the coarse step size would preferably be slightly larger than one. Thus, the method of expanding the range allows the user to continue rotating the rotary switch in both directions to alter the coarse step size and adjust the parameter until the desired parameter value is achieved.

Accordingly, there has been provided a means of providing additional scrolling capability to a rotary switch having a fixed number of positions through the use of the ratcheting and bump stop feature of the present invention. There has further been provided a method for expanding the range of the rotary switch by modifying the step size of the switch based on the range of a selected parameter and then narrowing the step size with each change in rotation based on current, previous and useable switch positions.

While the preferred embodiments of the invention have been illustrated and described, it will be clear that the invention is not so limited. Numerous modifications, changes, variations, substitutions and equivalents will occur to those skilled in the art without departing from the spirit and scope of the present invention as defined by the appended claims.

What is claimed is:

1. An electronic device, comprising:

a rotary switch for scrolling through a plurality of scrollable parameters, the rotary switch having a limited number of physical positions; and a bump stop for triggering a ratcheting function to increment and decrement the plurality of scrollable parameters beyond the limited number of physical positions of the rotary switch.

2. An electronic device, comprising:

an input for enabling and disabling a plurality of scrollable parameters;

a rotary switch for scrolling through the scrollable parameters, the rotary switch having a limited number of physical positions; and a bump stop for inhibiting rotation of the rotary switch and triggering a ratcheting function for the rotary switch, the ratcheting function expanding the scrollable parameters beyond the limited number of physical positions of the rotary switch.

3. The electronic device of claim 2, wherein the rotary switch increments and decrements the scrollable parameters with first and second rotations until the bump stop is hit in a first direction, in response to the bump stop being hit in the first direction the ratcheting function is enabled in the second direction and incrementing of the scrollable parameters is enabled in the first direction, and in response to the bump stop being hit in the second direction the ratcheting function is enabled in the first direction and decrementing of the scrollable parameters occurs in the second direction.

4. An electronic device, including:

a rotary switch having a limited number of physical positions;

a bump stop for inhibiting movement of the rotary switch; and the rotary switch having a ratcheting feature enabled by the bump stop for expanding the range of the rotary switch beyond the limited number of physical positions, the rotary switch rotating in first and second directions, rotation of the rotary switch in the first direction (hitting the bump stop) enables a ratcheting feature in the second direction and increments an electronic device parameter in the first direction; rotation of the rotary switch in the first direction (without hitting the bump stop) enables the electronic device parameter to be decremented in the second direction.

5. A rotary switch for an electronic device, comprising:

a limited number of physical switch positions associated with scrollable parameters of the electronic device;

a first scrollable parameter controlled by the rotary switch in which rotation in a first direction increments the first scrollable parameter and rotation in a second direction decrements the first scrollable parameter;

an input coupled to the electronic device for disabling the first scrollable parameter and enabling a second scrollable parameter, in response to the second scrollable parameter being enabled rotation of the rotary switch in the first direction increments the second parameter and rotation of the rotary switch in a second direction decrements the second parameter; and a bump stop coupled to the electronic device for inhibiting movement of the rotary switch and triggering a ratcheting function for expanding the scrollable parameters beyond the limited number of physical switch positions, the rotary switch hitting the bump stop in the first direction triggering the ratcheting function such that rotation of the switch in the second direction has no effect on the second scrollable parameter and rotation of the switch in the first direction increments the second scrollable parameter, and the rotary switch hitting the bump stop in the second direction triggering the ratcheting function such that rotation of the switch in the first direction has no effect on the second scrollable parameter and rotation of the switch in the second direction decrements the second scrollable parameter.

6. The rotary switch for the electronic device as described in claim 5, wherein the first direction is a clockwise direction and the second direction is counterclockwise direction.

7. The rotary switch for the electronic device as described in claim 5, wherein the first direction is counterclockwise direction and the second direction is a clockwise direction.

8. A rotary switch for an electronic device includes a limited number of physical switch positions and a bump stop for inhibiting rotation of the rotary switch, the bump stop triggering an electronic ratcheting function that inhibits scrolling through an electronic device parameter in one rotation direction and enables scrolling through the electronic device parameter in the opposite rotation direction, the number of electronic device parameters being greater than the number of physical switch positions.

9. The rotary switch of claim 8, wherein scrolling through an electronic device parameter comprises incrementing an electronic device parameter.

10. The rotary switch of claim 8, wherein scrolling through the electronic device parameter comprises decrementing the electronic device parameter.

11. An electronic device, including:

a rotary switch having a range of a predetermined number of positions;

a bump stop for inhibiting rotation of the rotary switch; and the rotary switch having a ratcheting feature enabled by the bump stop, the ratcheting feature expanding the range of the rotary switch beyond the predetermined number of positions, the rotary switch capable of rotating in a first direction and a second direction; and the rotary switch hitting the bump stop in the first direction enables ratcheting in a second direction and incrementing an electronic device parameter in the first direction; and the rotary switch hitting the bump stop in the second direction enables ratcheting in the first direction and decrementing the electronic device parameter in the second direction.

12. The electronic device of claim 11, wherein the electronic device is a radio communication device and the electronic device parameter is a PL code.

13. The electronic device of claim 11, the electronic device is a radio communication device and the electronic device parameter is a DPL code.

14. The electronic device of claim 11, wherein the electronic device is a radio communication device and the electronic device parameter is a zone.

15. A method of expanding the range of a rotary switch having a predetermined number of positions in an electronic device, comprising the steps of:

enabling a parameter of the electronic device, the parameter having a predetermined range to be controlled by the rotary switch;

determining a coarse step size based on the predetermined range of the parameter and the range of the rotary switch, each position of the rotary switch equating to one coarse step size;

turning the rotary switch in a first direction to increment the parameter in coarse steps towards a desired parameter value;

overshooting the desired parameter value by N positions;

turning the rotary switch in a second direction to narrow the step size and decrement the parameter with the narrowed step size, the narrowed step size being based on current parameter value, previous parameter value and number of usable switch positions;

overshooting the desired parameter value by N positions; and continue rotating and narrowing the step size in both directions until the desired parameter value achieved.

16. The method of claim 15, wherein N=1.

17. The method of claim 15, wherein N≧1.

18. The method of claim 15, wherein the range of the rotary switch is capable of being reset via a user input.

19. The method of claim 15, wherein the first direction is clockwise and the second direction is counterclockwise.

20. The method of claim 15, wherein the first direction is counterclockwise and the second direction is clockwise.

21. A method of expanding the range of a rotary switch for an electronic device, comprising the steps of:

determining the range of the rotary switch;

enabling an electronic device parameter to be controlled by the rotary switch;

determining a range for the enabled electronic device parameter;

distributing the range of the electronic device parameter across the range of the rotary switch to provide a coarse step size;

incrementing the electronic device parameter by the coarse step size by turning the rotary switch clockwise towards a desired parameter value;

overshooting the desired parameter value by one position;

turning the rotary switch counterclockwise to update the coarse step size and decrement the electronic device parameter, the coarse step size being updated by (current parameter value−previous parameter value)/number of usable switch positions;

overshooting the desired parameter value by one position;

turning the rotary switch clockwise to update the coarse step size and increment the parameter; and continue turning and overshooting with clockwise and counterclockwise rotations until the desired parameter value is achieved.

22. The method of claim 21, wherein the number of usable switch positions is determined by the distance from the current switch position to a bump stop of the rotary switch in the desired direction of rotation.

23. A method of expanding the range of a rotary switch in an electronic device, comprising the steps of:

enabling a parameter of the electronic device, the parameter having a predetermined range to be controlled by the rotary switch;

determining a coarse step size based on the predetermined range of the parameter and the range of the rotary switch, each position of the rotary switch equating to one coarse step size;

turning the rotary switch in a first direction to adjust the parameter in coarse steps towards a desired parameter value;

undershooting the desired parameter value by N positions;

turning the rotary switch in a second direction to alter the step size and adjust the parameter with the altered step size, the altered size being based on current parameter value, previous parameter value and number of usable switch positions;

undershooting the desired parameter value by N positions; and continue rotating in both directions to alter the coarse step size until the desired parameter value achieved.

24. A method of expanding the range of a rotary switch for an electronic device, comprising the steps of:

selecting a non-default parameter to be controlled by the rotary switch;

modifying a step size of the rotary switch based on the range of the selected parameter; and narrowing the range for the selected parameter with each change in rotation direction based on current, previous and useable switch positions.

25. The method of claim 24, wherein the step of narrowing the range comprises the step of narrowing the range for the selected parameter with each change in rotation direction based on current, previous and useable switch positions until the step size reaches one or less.

* * * * *